US010106968B1

(12) United States Patent
Reese

(10) Patent No.: US 10,106,968 B1
(45) **Date of Patent: *Oct. 23, 2018**

(54) PORTABLE SINK WITH REMOVABLE WATER PLATE

(71) Applicant: Metal Masters Foodservice Equipment Company, Inc., Clayton, DE (US)

(72) Inventor: Kenneth E. Reese, Townsend, DE (US)

(73) Assignee: Metal Masters Foodservice Equipment Co., Inc., Clayton, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/649,680

(22) Filed: Jul. 14, 2017

Related U.S. Application Data

(63) Continuation of application No. 14/727,969, filed on Jun. 2, 2015.

(51) Int. Cl.
*A47B 77/06* (2006.01)
*E03C 1/326* (2006.01)
*E03C 1/18* (2006.01)

(52) U.S. Cl.
CPC ..... *E03C 1/326* (2013.01); *E03C 1/18* (2013.01)

(58) Field of Classification Search
USPC ..... 4/657, 630, 619, 631, 654
See application file for complete search history.

(56) References Cited

U.S. PATENT DOCUMENTS 914,120 A 3/1909 Demarest
1,480,145 A 1/1924 Berven
2,334,951 A 11/1943 Parke
2,564,923 A 8/1951 Patton
2,850,742 A 9/1958 Glintz
3,070,812 A 1/1963 Skrmetia
3,206,770 A 9/1965 Carlson
5,014,371 A 5/1991 Heel
6,173,458 B1 1/2001 Maddux
6,175,970 B1 1/2001 Pinciaro
6,427,259 B1 8/2002 Cawthon
7,441,286 B1 10/2008 Parker
7,854,030 B2 * 12/2010 Lee ..... A47K 10/08 211/41.3
2005/0155147 A1 7/2005 Trepanier

OTHER PUBLICATIONS

Eagle Group Portable Sink Product Announcement (Published 2014).

* cited by examiner

*Primary Examiner* — Lauren Crane
(74) *Attorney, Agent, or Firm* — Rogowski Law LLC

(57) ABSTRACT

A work table is converted to a portable sink by joining the work table to a faucet spigot for connection to a water source. A removable water plate has a rear wall that extends upwardly from the upper surface of the water plate. The water plate further defines an opening that directs liquid(s) (e.g., water) to a drain. The rear wall of the water plate is removably insertable into a space or gap in a back wall of the table or work surface to mount the water plate between the faucet spigot and the work surface. A cassette defining an internal compartment that leads to a drain may be mounted to a back surface of the back wall of the work table. When a cassette is so mounted, the rear wall of the water plate then may be held inside the cassette, slidably engaged between a rod support inside the cassette and an internal wall of the cassette.

10 Claims, 8 Drawing Sheets

PORTABLE SINK WITH REMOVABLE WATER PLATE

CROSS-REFERENCE TO PRIOR APPLICATION

This application is a continuation of U.S. patent application Ser. No. 14/727,969, filed Jun. 2, 2015, now U.S. Pat. No. 9,790,674, the contents of which are incorporated herein by reference.

BACKGROUND

The present invention relates to kitchen equipment that may be converted from a work table or cabinet to a portable sink, and back again to a work table or cabinet, by removably mounting a water plate between a faucet spigot and a work surface to direct water toward a drain.

Some home and commercial kitchens have limited floor space for installing various equipment for efficient preparation of food. As a result, some kitchen designers specify purchase of multi-functional equipment, particularly equipment mounted to casters that readily may be moved from one location to the other within a confined kitchen floor space.

Self-contained, compact and mobile portable sinks are known, such as offered by Eagle Group. Portable sinks generally have a fresh water tank, a soiled water tank and a sink compartment or bowl therein. Water from the fresh water tank is directed into the sink compartment, and exits the sink compartment via a drain to the soiled water tank or to a building drain to a public sewer. The portable sinks are often installed over caster-mounted cabinetry into which the tanks are held. In one prior art embodiment offered by Eagle Group, the sink compartment or bowl was not installed in the table top. Instead, the table top remained a flat work surface, and a removable water plate was joined by hooks to a back wall of the work table to convert the work table to a sink. Liquid(s) impinging on the surface of the water plate were directed to a trough that led to the soiled water tank.

Improvements to equipment for efficient food preparation and clean up and improvements to portable sinks continue to be sought.

BRIEF SUMMARY

According to one preferred embodiment, a portable sink has a work surface and a faucet spigot adapted to direct liquid(s) toward the work surface. A back wall that serves as a backsplash extends upwardly from the work surface at or near a back edge of the work surface. The back wall defines an opening, such as an elongated slot. A rod is mounted behind the back wall, in an orientation generally parallel to the plane of the work surface. A water plate that has an upper surface, a bottom surface and a rear wall extending upwardly from the upper surface, defines a drain opening through which liquids may pass. The rear wall of the water plate is removably insertable into the opening of the back wall for contact with the rod to mount the water plate between the work surface and the faucet spigot. When the water plate is mounted between the work surface and the faucet spigot, the water plate upper surface is slanted rearwardly to direct liquid(s), such as water, poured onto the upper surface of the water plate to the drain opening.

In one preferred embodiment, the water plate upper surface defines a bend or channel to direct liquids poured onto the upper surface of the water plate to the drain opening. The water plate may be formed of materials suitable for durability and cleanliness within food service environments, such as thermoplastics, acrylics, polycarbonates, metals, or stainless steel.

In another preferred embodiment, a trim support extends from the back wall at or near the opening defined in the back wall. The trim support is adapted to contact the bottom surface of the water plate when the water plate is installed to convert the work table to a portable sink.

In yet another preferred embodiment, a cassette is mounted behind the back wall of the portable sink. The cassette defines an internal compartment and the rod support is supported within the internal compartment of the cassette. At least a portion of the rear wall of the water plate is slidably engageable between an internal wall (such as a rear wall) of the cassette and the rod support to hold the water plate in position mounted above the work surface. The cassette further includes a drain for directing liquids out of the internal compartment of the cassette. The drain opening of the water plate is in fluid communication with the internal compartment of the cassette. The cassette may be joined to the back wall of the table by a fixed angle support extending from a rear surface of the back wall. A top portion of the cassette fits within the fixed angle support to align the cassette with the back wall. The cassette may be further joined to the back wall of the table or to the underside of the table by a flange extending from a bottom portion of the cassette and adapted to be fastened to a bottom surface of the work surface.

The work surface of the portable sink may be supported above a floor by one or more supports, such as support posts or casters mounted on support posts, or furniture or cabinetry.

The invention also comprises a water plate to convert a work table or food preparation table to a portable sink. The water plate has an upper surface defining a drain opening through which liquid(s) may pass, a bottom surface opposite the upper surface, and a rear wall extending upwardly from the upper surface, the rear wall defining a slot that communicates with the drain opening. Preferably, the upper surface of the water plate is slanted rearwardly to direct liquid(s) poured onto the upper surface of the water plate to the drain opening. Preferably, the upper surface of the water plate defines at least one bend or channel to direct liquid(s) poured onto the upper surface of the water plate to the drain opening. The water plate may be formed of materials suitable for durability and cleanliness within food service environments, such as thermoplastics, acrylics, polycarbonates, metals, or stainless steel.

The invention further comprises a cassette to convert a work table or food preparation table to a portable sink. The cassette comprises a compartment having a rear wall, a front wall defining an opening, side walls, and a bottom wall defining drain opening, wherein said rear wall, front wall, side walls and bottom wall define an internal volume of the cassette. Preferably, the bottom wall serves as a trough and is slanted toward the drain opening. A rod extends between the side walls in the internal volume and is supported in a position that is above the bottom wall and spaced apart from the rear wall. The rod is adapted for contacting a portion of a water plate of a portable sink. A flange extends outwardly of the front wall of the cassette for joining the compartment to a table or furniture element of a work surface. A top may be installed over the internal volume. Preferably, a second flange extends from the top for joining the top to a back wall of the table or furniture element of the work surface.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 2:
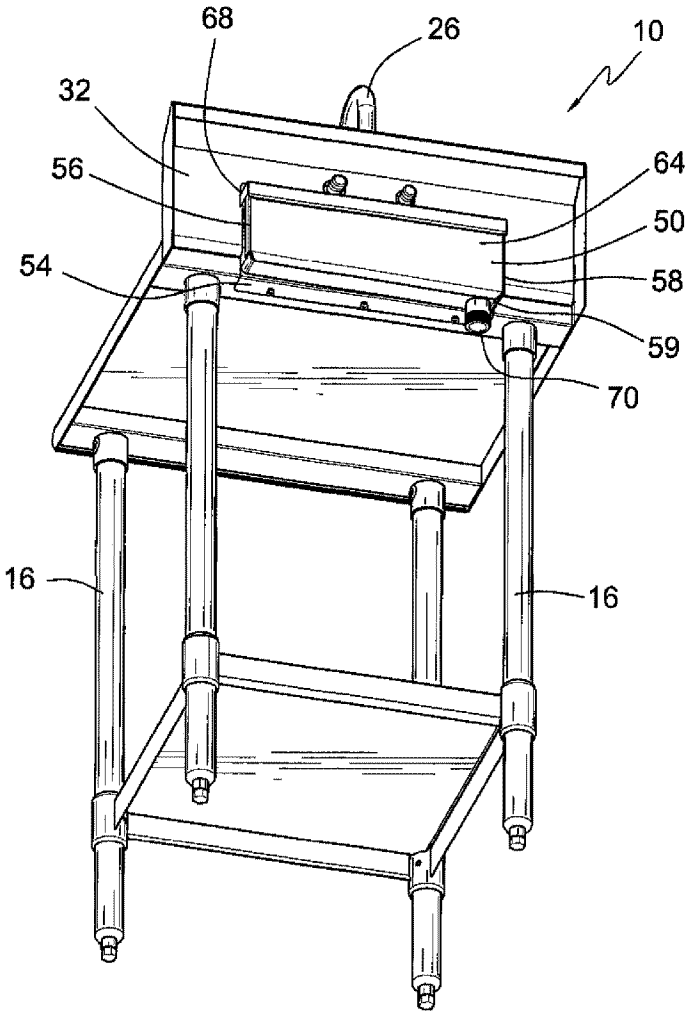
FIG. 2 is a left rear perspective view of the table with portable sink of FIG. 1.
Figure 1:
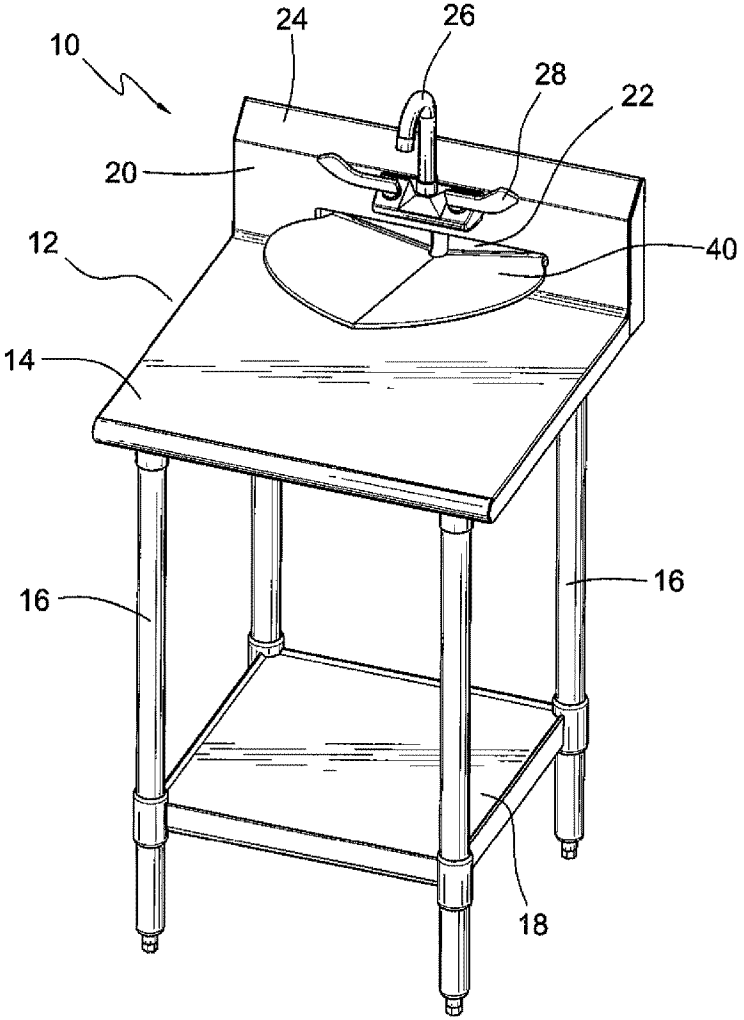
FIG. 1 is a right front perspective view of a table with a portable sink according to the invention.
Figure 3:
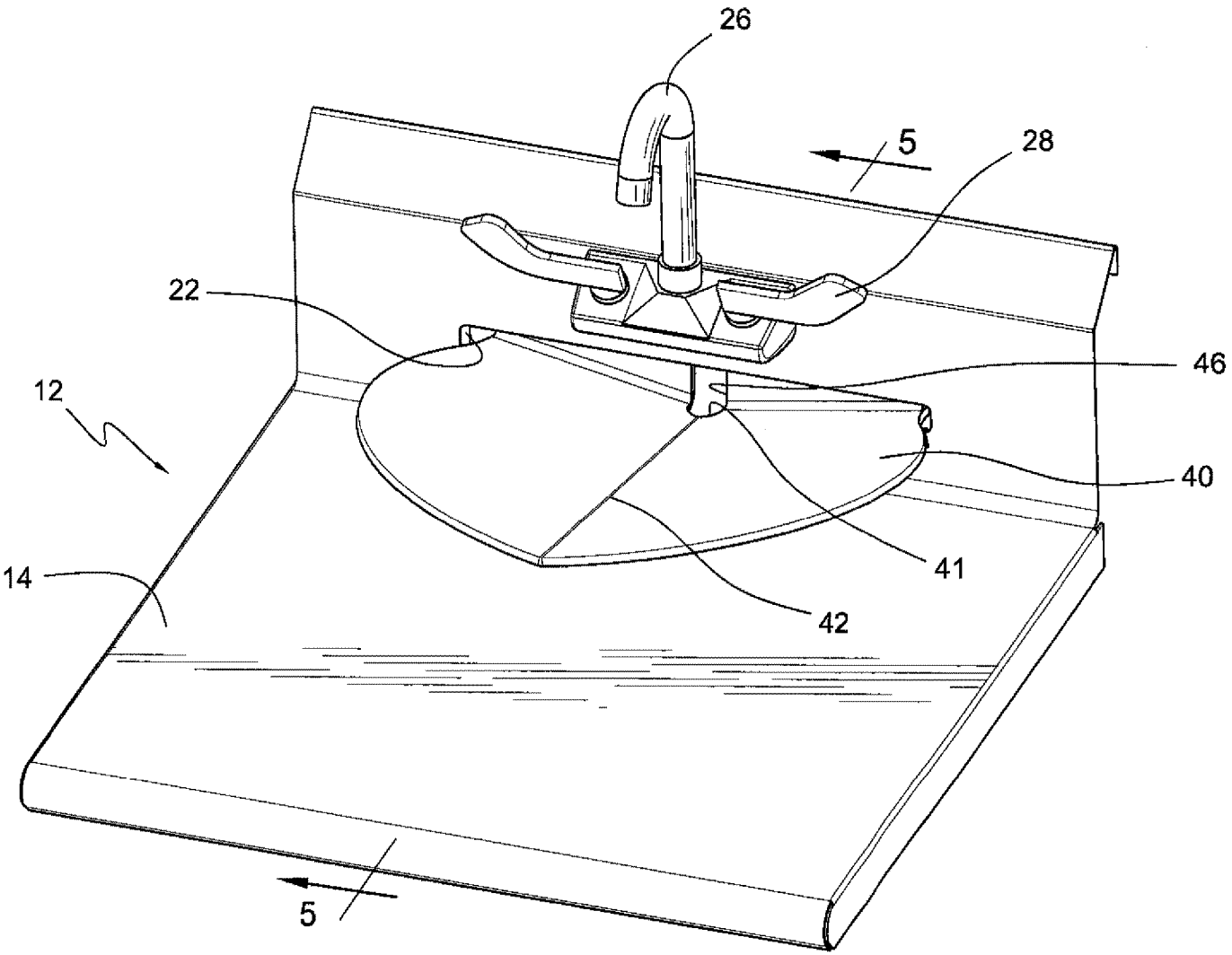
FIG. 3 is a right front perspective view of a tabletop with a portable sink.

Reference will now be made in detail to the present embodiment of the invention illustrated in the accompanying drawings. The same or like reference numbers may be used in the drawings to refer to the same or like features. It should be noted that the drawings are in simplified form and not drawn to a precise scale.

In reference to the disclosure herein, for purposes of convenience and clarity only, directional terms such as top, bottom, above, below, front, rear, right, left, inner, and outer, are used with respect to the accompanying drawings. Such directional terms used in conjunction with the following description of the drawings should not be construed to limit the scope of the invention in any manner not explicitly set forth herein. Unless specifically set forth herein, the terms "a", "an" and "the" are not limited to one element but instead should be read as meaning "at least one". The terminology includes the words noted above, derivatives thereof and words of similar import.

Figure 8:
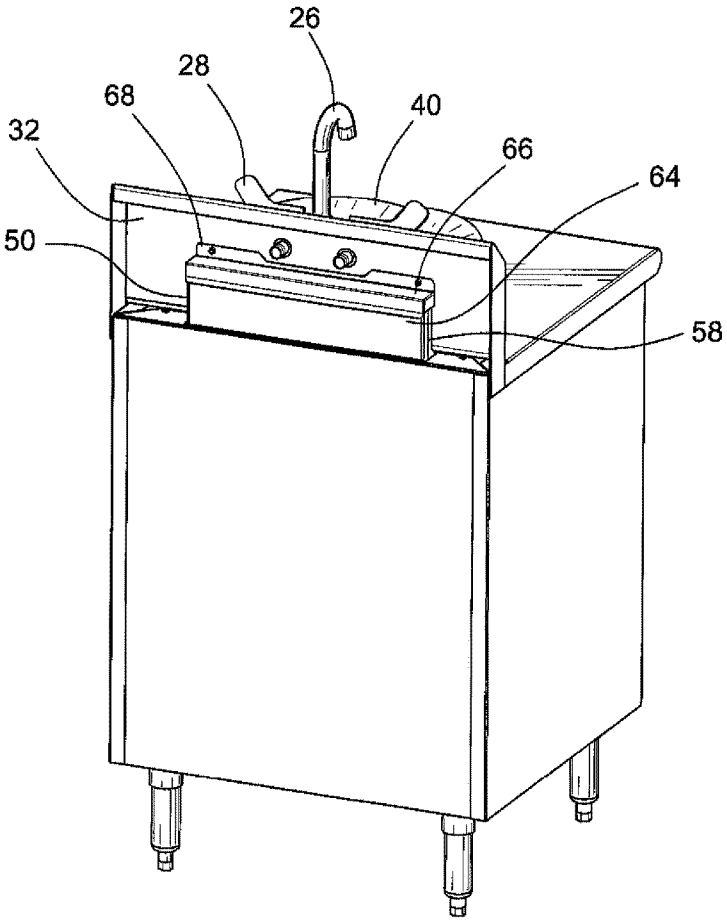
FIG. 8 is a left rear perspective view of the cabinet with a portable sink of FIG. 7.
Figure 7:
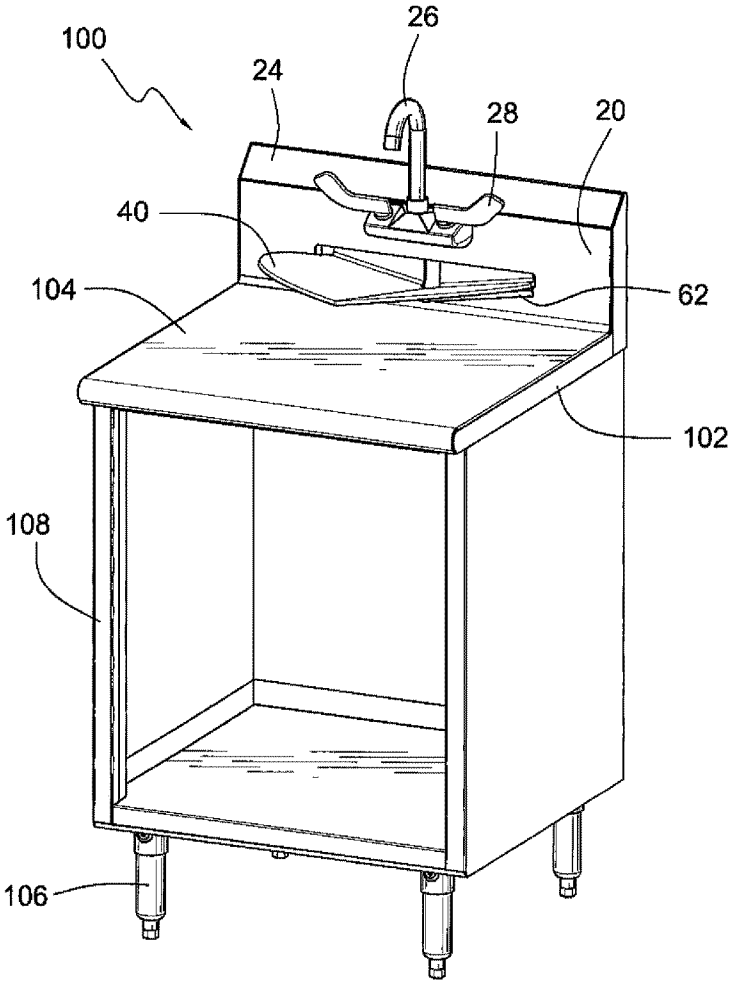
FIG. 7 is a right front perspective view of a cabinet with a portable sink according to the invention.

Turning in detail to the drawings, FIGS. 1-4A, 5, 6 and 10 show one embodiment of a portable sink 10 in the form of a table 12 with a work surface 14 supported by support posts 16. An optional shelf 18 is joined to the support posts 16 below the work surface 14. FIGS. 4B, 7 and 8 show an alternative embodiment of a portable sink 100 in the form of a cabinet 108 with a table 102 having a work surface 104 supported by support posts 106. In either embodiment, casters (not shown in the Figures) may be installed at the bottom of the support posts to allow the portable sinks 10, 100 to be more readily moved from one location to another location.

Referring to FIGS. 1-4A, a back wall 20 extends upwardly from the rear of the work surface 14 of the portable sink 10. The back wall 20 forms a back splash and defines a slot or opening 22 leading to an internal volume of a cassette 50 that directs liquid(s), such as water, to a trough in the cassette 50 and in turn to a drain pipe 70 to direct used liquid(s), such as soiled water, to a holding tank or to drain used liquic(s) to a public sewer system.

A faucet spigot 26 and water control handles 28 are mounted to the portable sink 10. Shown in FIG. 1, the faucet spigot 26 directs liquid(s) (e.g., water) toward the work surface 14. The faucet spigot 26 and control handles 28 are mounted by customary hardware (not shown) to the back wall 20 of the portable sink 10.

Figure 4A:
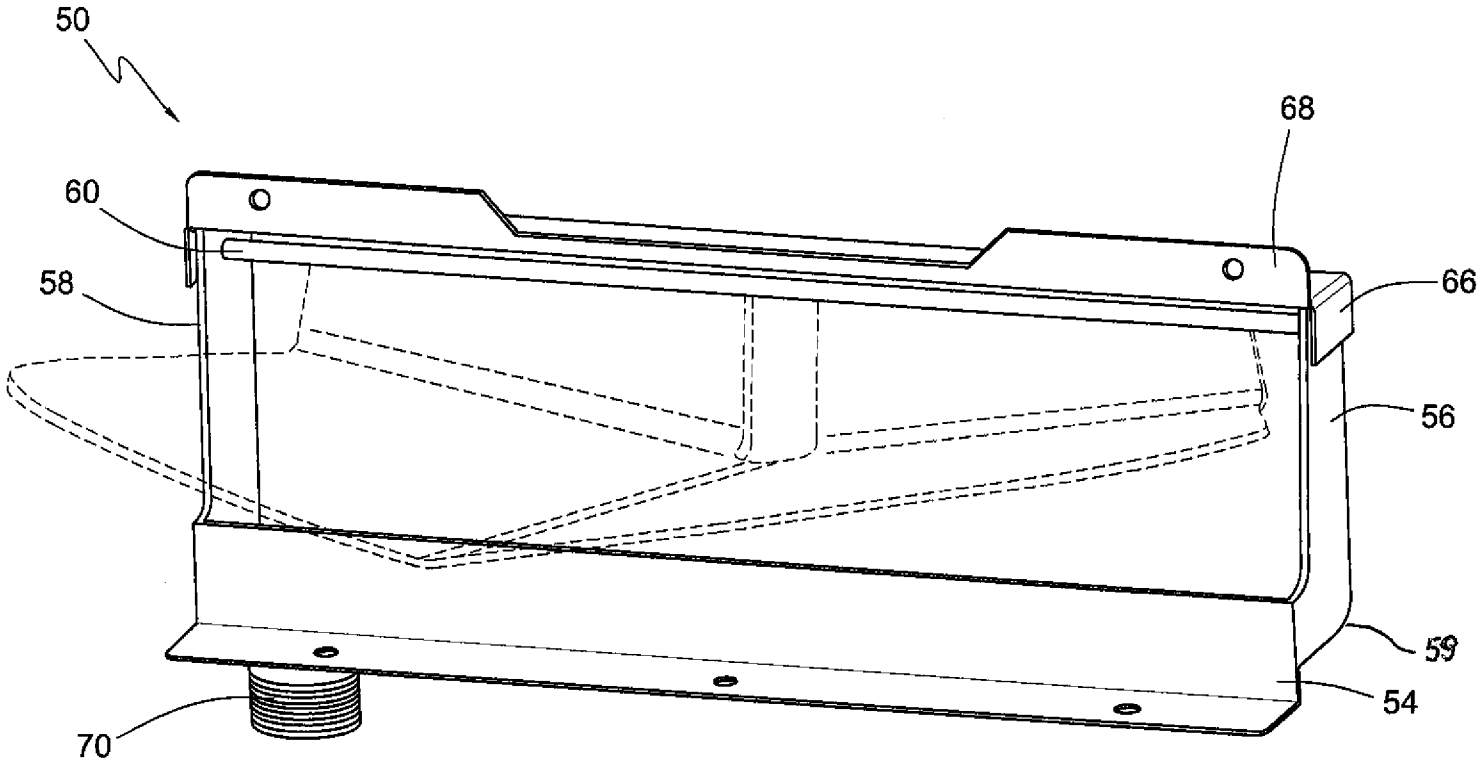
FIG. 4A is a right front perspective view of a first embodiment of a cassette for a portable sink.

Shown in FIGS. 2 and 4A, a first embodiment of the cassette 50 has a front, a back wall 64, bottom wall 59 and side walls 56, 58 that together define an internal compartment of the cassette 50. A rod support 60 extends along the length of the cassette 50 and is held in the internal compartment between the two side walls 56, 58 at a location spaced apart from the back wall 64. The rod support 60 may be a round rod (circular in cross-section) with a diameter in the range of from about ¼ inch to ½ inch. Optionally, the rod support may have other cross-sectional shapes, although a round rod is preferred. Preferably, the rod support 60 is formed materials manufactured for durability and cleanliness within food service environments, such as stainless steel, a thermoplastic or a ceramic.

The cassette 50 is removably engaged to a rear surface 32 of the back wall 20. The front of the cassette 50 is placed in abutting relation to the rear surface 32 of the back wall. The upper edges of the front, the back wall 64 and side walls 56, 58 are placed into contact with a bottom surface of a cover 66. The cover 66 is joined by fixed angle 68 and fasteners (e.g., screws or bolts) to the rear surface 32 of the back wall. An angle support 54 extends outwardly from the cassette 50 at or near its bottom wall 59. The angle support 54 is removably affixed to the underside of the table 12 with fasteners (e.g., screws or bolts) (See FIGS. 5 and 6).

A drain pipe 70 is installed in fluid communication with the internal compartment of the cassette 50. The bottom wall 59 of the cassette 50 forms a trough and may be slanted to direct liquid(s) received in the cassette toward the drain 70. In one embodiment, the bottom wall 59 is slanted at an angle from horizontal of about 0.5° to about 10°.

Figure 9:
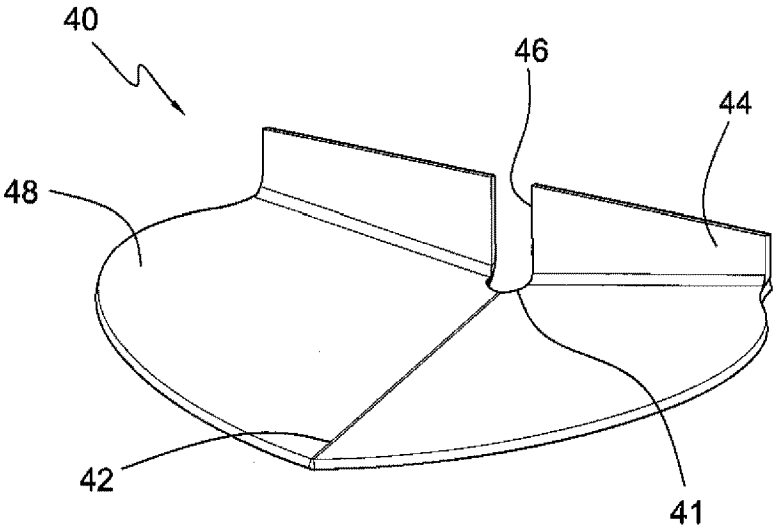
FIG. 9 is a right front perspective view of a water plate.

An exemplary water plate 40 is shown in FIG. 9. The water plate has an upper surface 48, a bottom surface opposite the upper surface, and a rear wall 44 extending upwardly from the upper surface at or near a rear portion of the upper surface. The upper surface defines a drain opening 41. The rear wall 44 defines a slot opening 46 in communication with the drain opening 41. The water plate 40 defines a bend 42 in its upper surface 48 to direct liquid(s) to the drain opening 41. In one embodiment, the upper surface 48 is angled toward the rear wall 44 at an angle from horizontal in the range of from about 80° to about 110°, and the upper surface is bent toward bend 42 at angles in the range of about 5° to about 30°.

Figure 10:
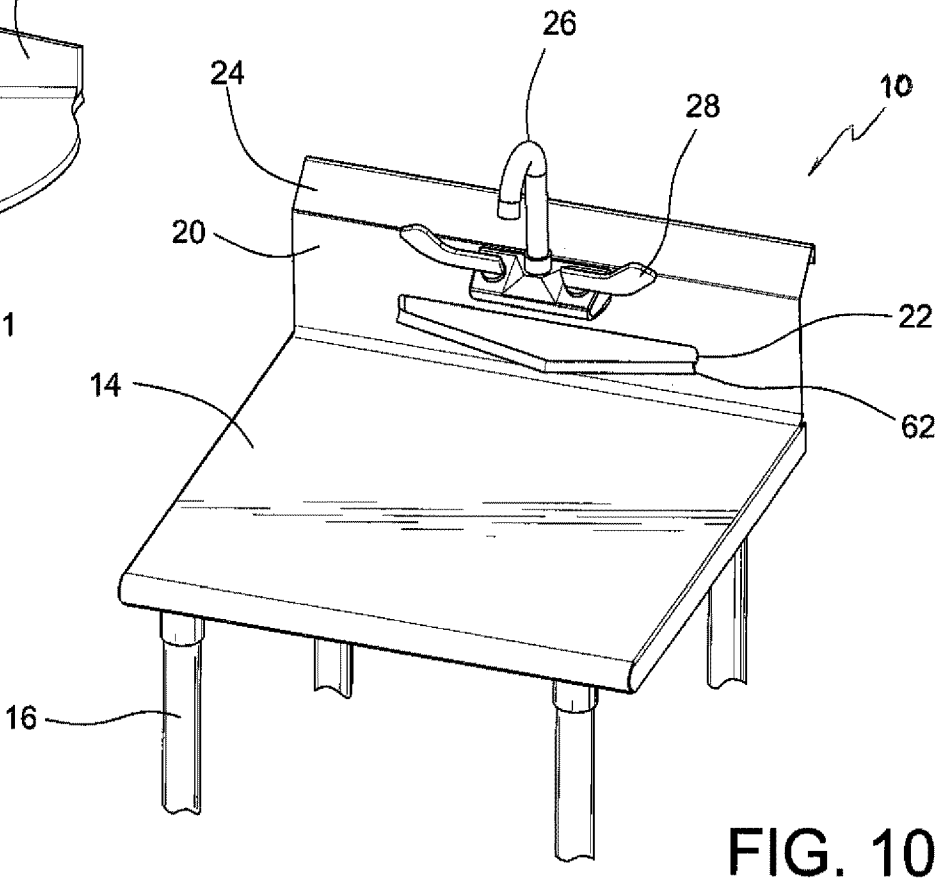
FIG. 10 is a right front perspective view of a tabletop with water plate removed.

FIG. 10 shows the portable sink 10 without a water plate installed therein. The back wall 20 defines an opening 22, which in this embodiment has a generally straight upper edge and angled bottom edges. The angled bottom edges generally match the angle of bend 42 of water plate 40. A removable trim support 62 may be installed over the bottom edge(s) of the opening 22. The removable trim support 62 may extend outwardly from the face surface of the back wall 20 and further supports the bottom surface of the water plate when the water plate is installed into the portable sink 10. The removable trim support 62 protects the bottom surface of the water plate from direct contact with the bottom edge(s) of the opening 22.

Figure 5:
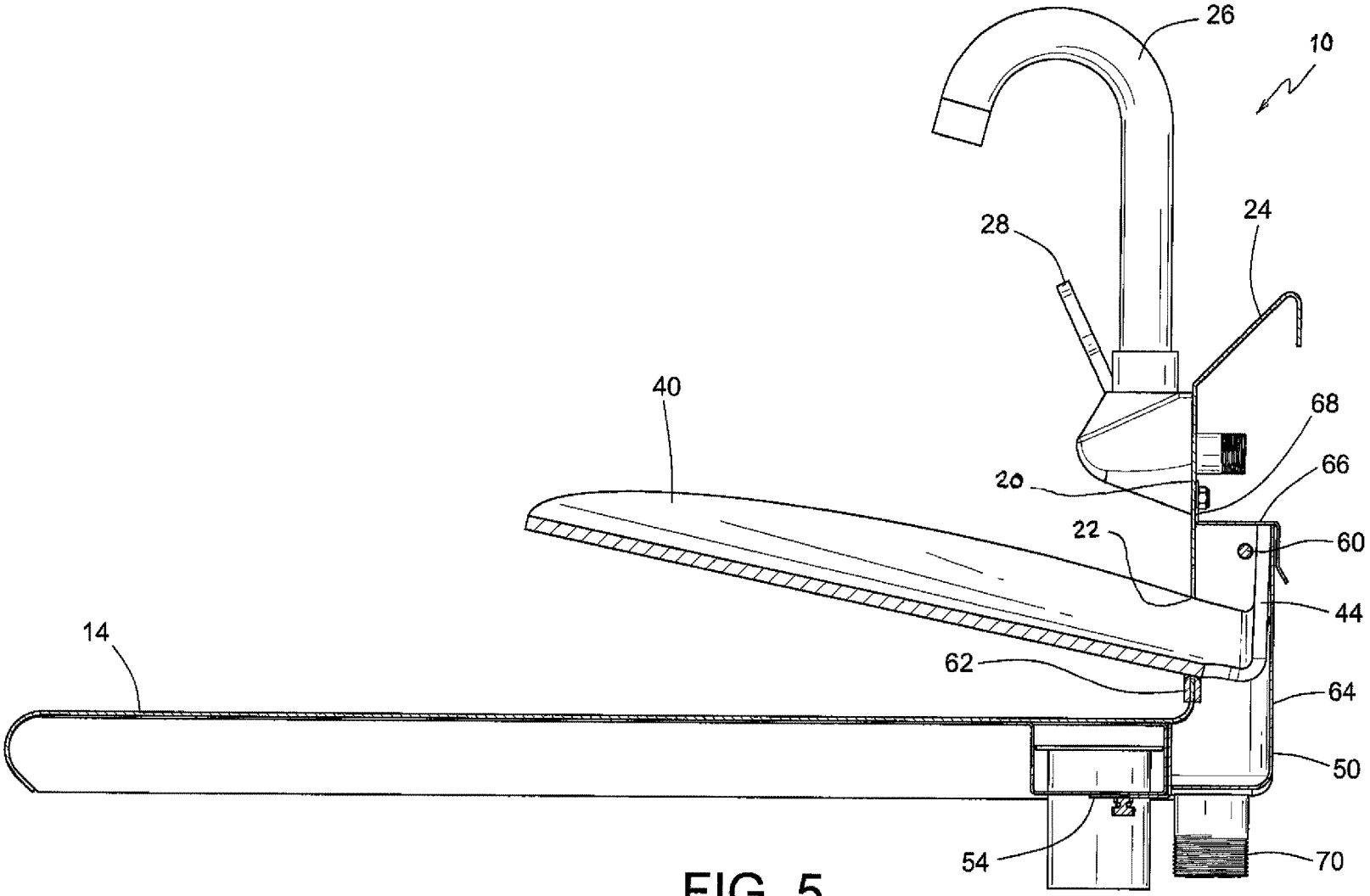
FIG. 5 is a partial cross-sectional view taken along line 5-5 in FIG. 3.
Figure 6:
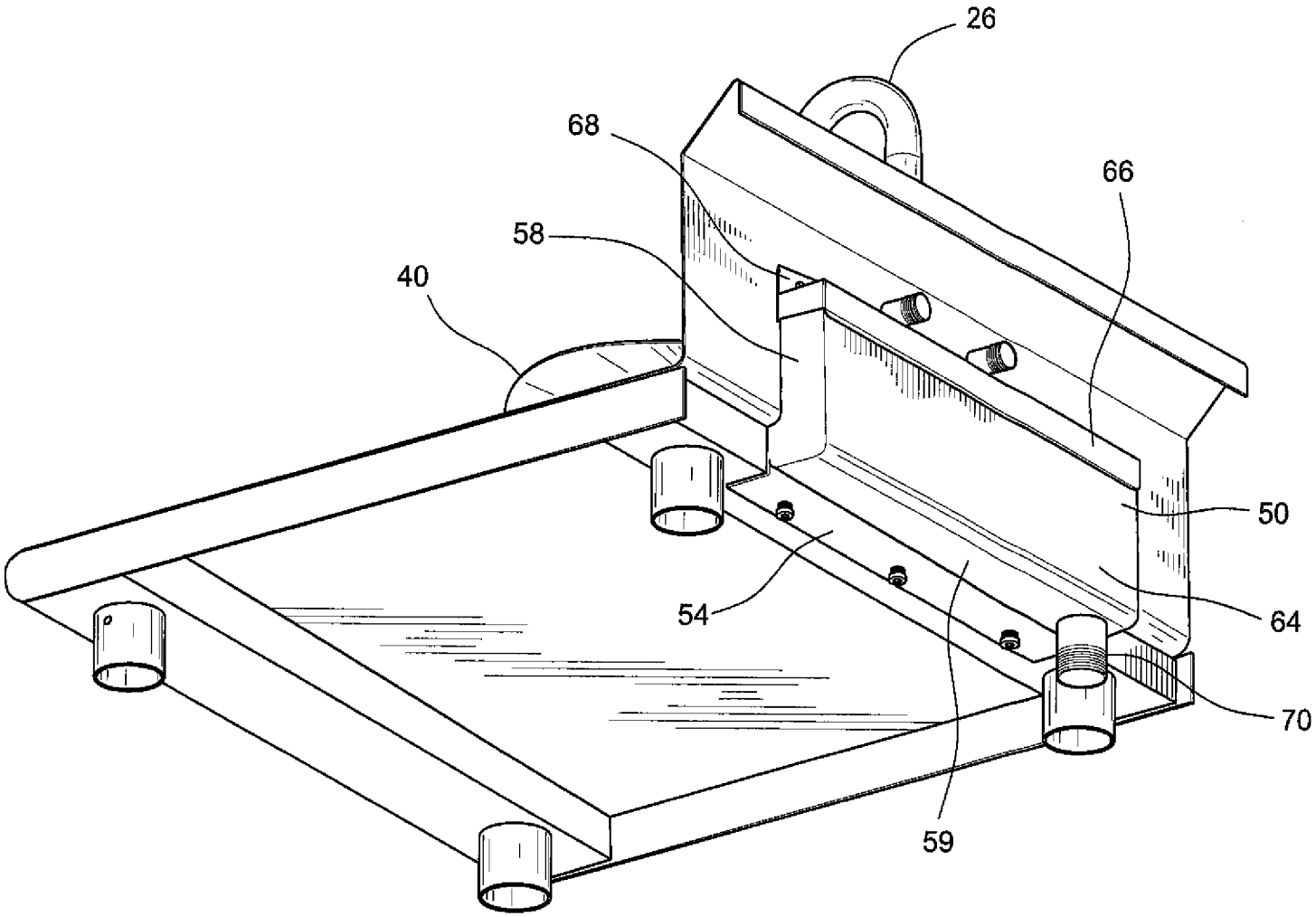
FIG. 6 is a left rear bottom perspective view of the tabletop with a portable sink of FIG. 3.

Referring now to FIG. 5, the water plate 40 is shown installed in the portable sink 10. The rear wall 44 of the water plate 40 is slidably engaged between the rod support 60 and the back wall 64 of the cassette 50. The bottom surface of the water plate 40 contacts the trim support 62. There are no fasteners to connect the water plate to the work surface 14, the back wall 20 or the cassette 50. The rear wall 44 of the water plate 40 is held between the rod support 60 and the back wall 64 of the cassette 50 without adhesives or other fasteners. The water plate 40 may be readily disengaged from the back wall 64 and the cassette 50 by sliding the rear wall 44 of the water plate out of engagement with the rod support 60 and removing it from the internal volume of the cassette through the slot 22 in the back wall 20 of the portable sink 10.

Preferably the rear wall 44 of the water plate 40 has a substantially uniform thickness. The water plate 40 may be made of transparent sheet materials, such as, but not limited to, glass, acrylic, polycarbonate and thermoplastic sheet materials, and particularly sheet materials manufactured for durability and cleanliness within food service environments. The water plate 40 can be separated from the portable sink 10 and cleaned or washed.

Preferably the work surface 14 and back wall 20 of the portable sink 10 are formed of materials manufactured for durability and cleanliness within food service environments, such as stainless steel or melamine. Preferably, the cassette 50 is formed of materials manufactured for durability and cleanliness within food service environments, such as stainless steel, melamine or laminated plywood. Because the cassette 50 can be removed from its connection with the table 12, and because the cassette 50 is formed of materials manufactured for durability and cleanliness, the cassette 50 can more readily be cleaned or washed, such as in commercial dish washing equipment.

Figure 4B:
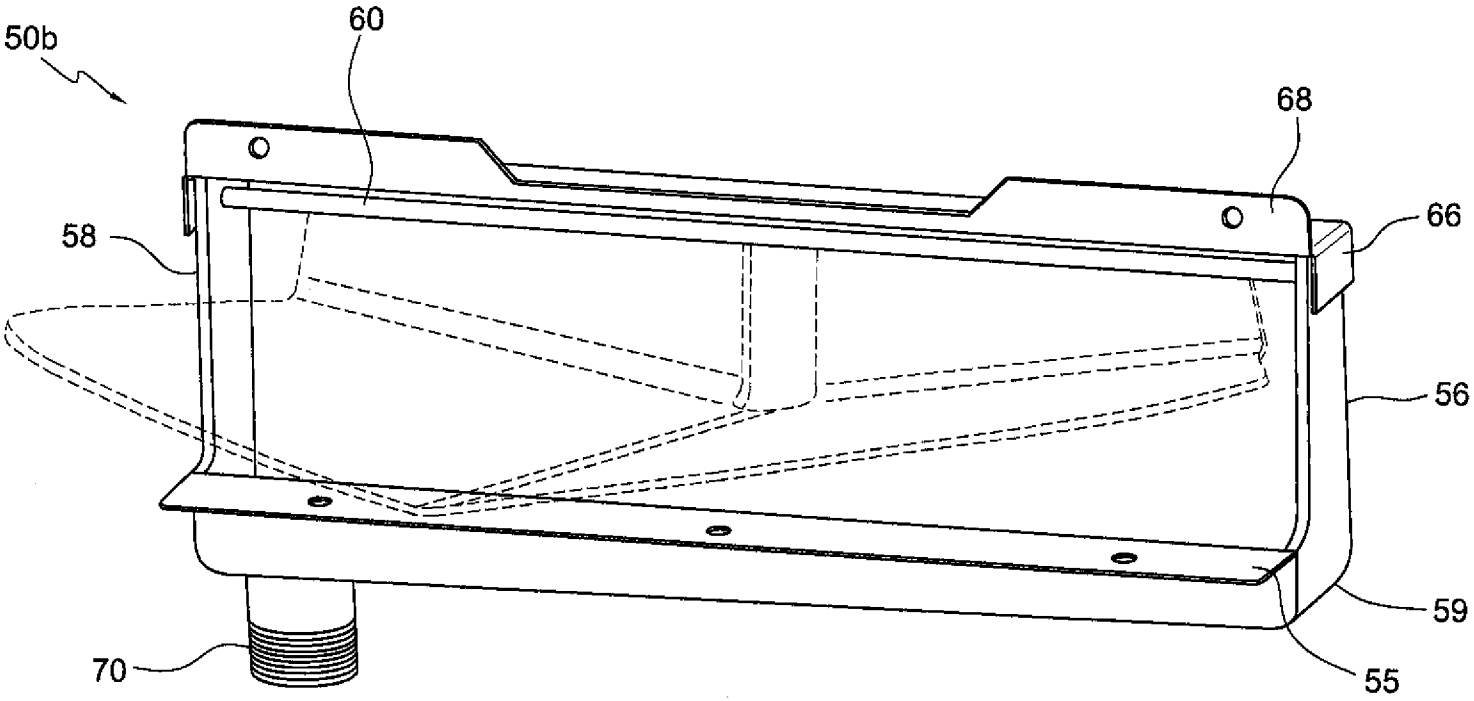
FIG. 4B is a right front perspective view of a second embodiment of a cassette for a portable sink.

FIGS. 4B, 7 and 8 show an alternative embodiment of a portable sink 100 and cassette 50*b*. In this embodiment, the cassette 50*b* has a front, a back wall 64, bottom wall 59 and side walls 56, 58 that together define an internal compartment of the cassette 50*b*. A rod support 60 extends along the length of the cassette 50*b* and is held in the internal compartment between the two side walls 56, 58 at a location spaced apart from the back wall 64. The cassette 50*b* of this alternative embodiment is removably engaged to a rear surface 32 of the back wall 20 that extends up from the work surface 104. The front of the cassette 50*b* is placed in abutting relation to the rear surface 32 of the back wall. The upper edges of the front, the back wall 64 and side walls 56, 58 are placed into contact with a bottom surface of a cover 66. The cover 66 is joined by fixed angle 68 and fasteners (e.g., screws or bolts) to the rear surface 32 of the back wall 20. A different angle support 55 extends outwardly from the front of the cassette 50*b*. The angle support 55 is removably affixed to the underside of the back wall 20 that rises from the work surface 104 with fasteners (e.g., screws or nuts and bolts) (See FIG. 8).

Kitchen workers may use the work surface 14, 104 of either embodiment as a work table, cutting table or food preparation table when the water plate 40 is removed, such as shown in FIG. 10. The water plate 40 may be mounted over the work surface 14, 104 by inserting the rear wall 44 of the water plate 40 into the opening or slot in the back wall 20 of the portable sink 10, 100, and sliding the rear wall 44 between the support rod 60 and the back wall of the cassette 50. The water plate 40 is held above the work surface 14, 104 to convert the work table or cabinet into a portable sink 10, 100, such as shown in FIGS. 1, 2, 7 and 8.

As such, it will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

REFERENCE NUMERALS

10 portable sink
12 table
14 work surface
16 support posts
18 shelf
20 back wall
22 opening in back wall
24 top surface of back wall
26 faucet spigot
28 faucet handles
40 water plate
41 drain opening
42 bend/channel in water plate
44 rear wall of water plate
46 slot opening in rear wall
48 upper surface
50 cassette
54 angle support/flange
55 alternative angle support/flange
56 side wall of cassette
58 side wall of cassette
59 bottom wall of cassette
60 rod support
62 removable trim support
64 back wall of cassette
66 cap or cover of cassette
68 angle to support water plate
70 drain pipe
100 portable sink
102 table
104 work surface
106 support posts
108 cabinet/furniture

I claim:

1. A cassette for a portable sink, comprising:

a water plate adapted to receive liquids thereon;

a compartment having a rear wall, a front defining an opening, side walls, and a bottom wall defining drain opening, wherein said rear wall, front, side walls and bottom wall define an internal volume;

a top over the internal volume;

a rod having a first end and a second end, said rod extending between the side walls in the internal volume with its first end at or joined to one side wall and its second end at or joined to the opposite side wall, said rod spaced apart from the rear wall and adapted for contacting a portion of the water plate of the portable sink to support the water plate above a work surface of the portable sink;

a flange extending outwardly of the front for joining the compartment to a table or furniture element of a work surface; and a second flange extending from the top and outside of the internal volume for joining the top to a back wall of the table or furniture element of the work surface.

2. The cassette of claim 1, wherein the bottom wall is slanted toward the drain opening.

3. The cassette of claim 1, wherein the water plate has an upper surface that is slanted rearwardly to direct liquids poured onto the upper surface of the water plate to the drain opening of the cassette.

4. The cassette of claim 1, wherein the water plate has a rear wall and a portion of the rear wall of the water plate is slidably engagable between the rod and an internal wall of the cassette to join the water plate to the cassette.

5. A portable sink, comprising:

a work surface;

a back wall extending upwardly at or near a back edge of the work surface, said back wall defining an opening with an opening width and an opening height;

a rod mounted behind the back wall, said rod having a length extending at least as long as the opening width; and a water plate having an upper surface, a bottom surface opposite the upper surface and a rear wall extending upwardly from the upper surface, the water plate defining a drain opening through which liquids may pass, wherein the rear wall of the water plate is removably insertable into the opening of the back wall for contact with the rod to mount the water plate over the work surface with the bottom surface spaced apart from and above the work surface.

6. The portable sink of claim 5, wherein the water plate upper surface is slanted rearwardly to direct liquids poured onto the upper surface of the water plate to the drain opening.

7. The portable sink of claim 5, further comprising one or more supports that support the work surface above a floor.

8. The portable sink of claim 5, further comprising furniture or cabinetry supporting the work surface above a floor.

9. The portable sink of claim 5, a drain for directing liquid out of the portable sink.

10. The portable sink of claim 5, further comprising a spigot adapted to direct liquid onto the work surface or onto the upper surface of the water plate.

* * * * *